United States Patent [19]

Burns

[11] Patent Number: 4,528,800

[45] Date of Patent: Jul. 16, 1985

[54] CARTON FLAP HOLDER

[75] Inventor: William Burns, La Mesa, Calif.

[73] Assignee: Sony Corporation, Tokyo, Japan

[21] Appl. No.: 481,675

[22] Filed: Apr. 4, 1983

[51] Int. Cl.[3] ..... B65B 43/26

[52] U.S. Cl. ..... 53/492; 24/570

[58] Field of Search ..... 53/390, 492, 381 R, 53/387, 138 R, 396; D32/61; 269/41; 24/570, 563, 198, 30.5 S

[56] References Cited

U.S. PATENT DOCUMENTS

| | | | |
|---|---|---|---|
| 1,618,384 | 2/1927 | Morris | 24/570 |
| 2,938,252 | 5/1960 | Scheemaeker | 24/563 |
| 2,950,514 | 8/1960 | Small | 24/570 |
| 3,636,597 | 1/1972 | Barnickel | 24/198 |
| 4,410,379 | 10/1983 | Franckx | 156/91 |

FOREIGN PATENT DOCUMENTS

| | | | |
|---|---|---|---|
| 6313 | 3/1896 | United Kingdom | 24/198 |

*Primary Examiner*—Francis S. Husar
*Assistant Examiner*—Linda McLaughlin
*Attorney, Agent, or Firm*—Lewis H. Eslinger; Alvin Sinderbrand

[57] ABSTRACT

A holder is provided to retain the closure flaps of a carton or container in an open configuration. The holder has three projecting prongs extending in parallel, spaced-apart relation from a spine portion. In using such holder, the central prong is extended downwardly at the inside of a corner of the carton while the two outer prongs extend downwardly at the outside of the carton adjacent the corner. When the holder is thus used, closure flaps of the carton, which are hinged to respective sides of the carton at the top, are held in downwardly folded open positions by the outer prongs of the holder.

5 Claims, 4 Drawing Figures

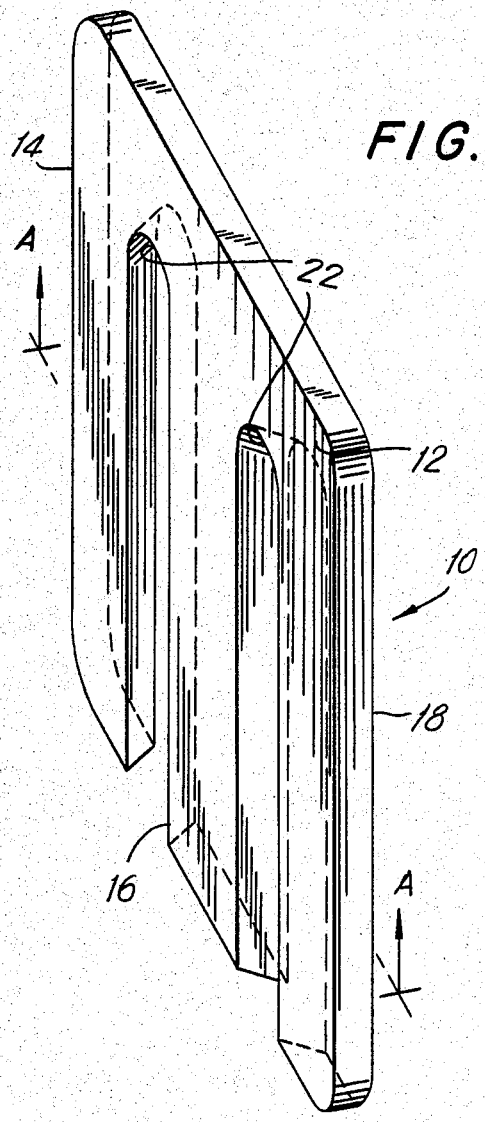
FIG. 1
FIG. 2
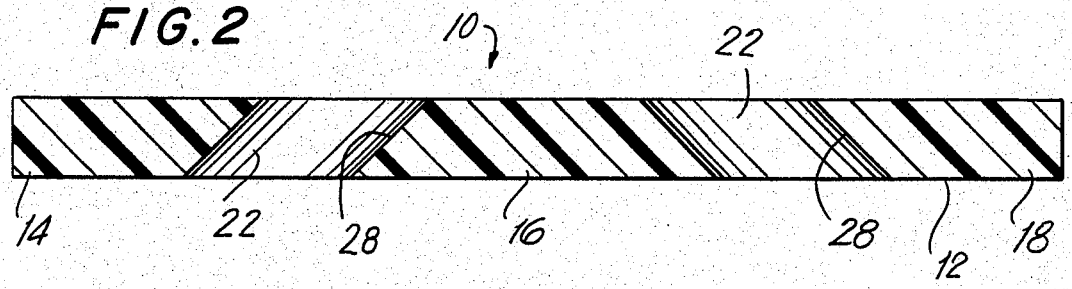

CARTON FLAP HOLDER

BACKGROUND OF THE INVENTION

1. Field of the Invention

This invention relates generally to a novel holder for a container and, more particularly, pertains to an inexpensive holder which can be easily affixed to a container or carton in such a manner as to retain the flaps of the container in an open configuration.

2. Discussion of the Prior Art

Containers, or cartons, normally in the form of cardboard boxes and the like, are presently extensively used in commercial operations which employ an 'assembly line' type procedure for assembling partially manufactured or otherwise unfinished products. Particularly, there are numerous instances in industrial assembly line applications wherein it is desirable to manipulate one or more pieces after removal from a carton or box, and then to return the resulting assembly to the carton or box for further transport or storage therein. The cartons or boxes used for such storage or transport conventionally have closure flaps hinged to the side walls at the top thereof, and which usually tend to resiliently return toward their closed positions, thereby interfering with the removal and return or reinsertion of the part or assembly in each box.

Fasteners have been used heretofore in assembly line situations for holding the flaps of each carton or box in the open condition thereof. Such fasteners typically include clips which are generally of a U- or V-shaped configuration and which are normally placed over an edge of the carton from which a closure flap extends. Typically, an operator first opens a flap and folds it down against the outer surface of a sidewall of the container. A U- or V-shaped clip is then placed over the hinged connection of the carton sidewall and flap whereby the center of base of the clip is positioned above the fold or hinged connection between the carton sidewall and flap and the arms of the clip extend along inner and outer surfaces of the sidewall and flap of the container, respectively. Such clips can be made of many materials and can also be provided with spring retaining means of various types in order to aid in tightly gripping the container or carton in the above-described manner.

However, these existing clips or fasteners have numerous disadvantages. Particularly, the known fasteners are normally adapted to secure only one flap of the container, so that four fasteners are required for each carton or container on the assembly line. Further, many clips having spring-loaded retaining means incorporated into the overall configuration. In order to effectively grip the container this gripping mechanism is disposed above the base of the clip which inherently necessitates a much larger spine of the clip and, more importantly, requires the clip to substantially extend above the opening of the container thereby creating an obstruction interfering with the operator's access to the contents of the container. Such obstruction can be especially undesirable when considered in relation to an automated assembly line where additional programming of devices, used to remove and return pieces in each container, may be required.

OBJECTS AND SUMMARY OF THE INVENTION

The present invention provides a novel carton flap holder which effectively overcomes the aforementioned problems. Particularly, the present invention provides a carton flap holder which is inexpensively and easily manufactured and is capable of maintaining the closure flaps of a carton or container in an open configuration.

Still another object of the present invention is to provide a device, as aforesaid, which is easily operable on an assembly line wherein the device or flap holder can be easily placed upon the container.

A further object of the present invention is to provide a device or flap holder, as aforesaid, which is safe and which has no moving parts or spring-loaded mechanisms which may cause injury or damage to the operator thereof.

In accordance with an aspect of the present invention, a device for holding or securing the closure flaps of a container or carton in the open condition is provided and incorporates a spine having three prongs extending therefrom. The holder is typically placed in a corner of the container, with the central prong extending inwardly along the corner edge of the container and each of the outer prongs extending outwardly along the face of their respective flaps which have been previously folded into an open position. The holder is then slid downwardly into the container thereby allowing a single holder of the present invention to effectively grip and retain two of the container's closure flaps.

BRIEF DESCRIPTION OF THE DRAWINGS

The foregoing and other objects, advantages and characterizing features of the inventive container holder will become more readily apparent from the following detailed description of a preferred embodiment thereof, taken in conjunction with the accompanying drawings wherein like reference numerals denote similar parts throughout the various views and in which:

FIG. 1 is a perspective view of a carton flap holder according to an embodiment of the present invention;

FIG. 2 is a cross-sectional view taken about Line A—A on FIG. 1;

DESCRIPTION OF THE PREFERRED EMBODIMENTS

Figure 3:
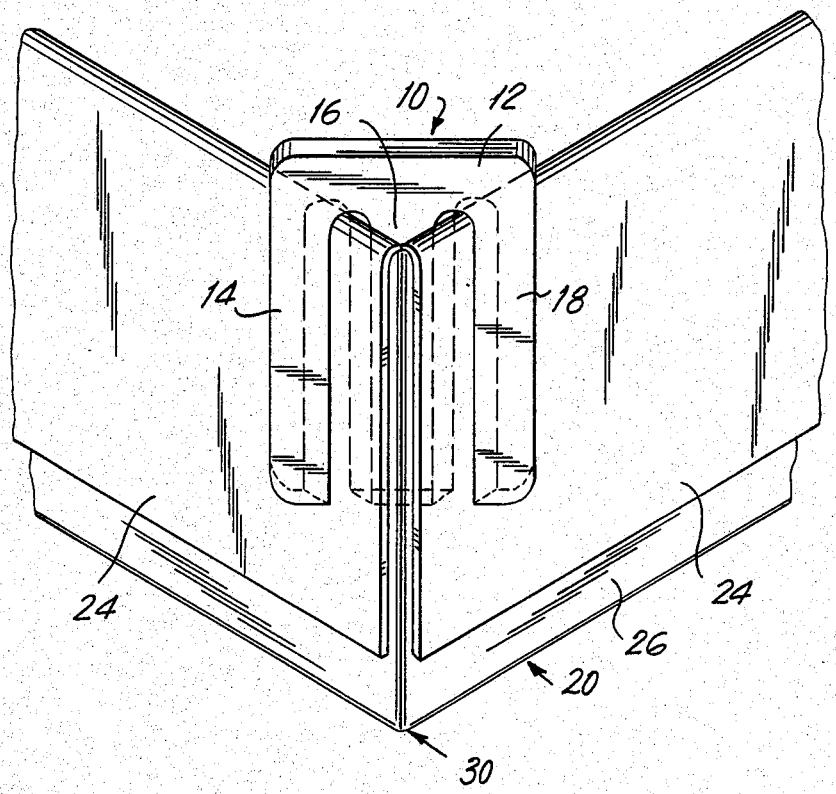
FIG. 3 is another perspective view of the holder shown in operation position on a container.

Referring now in detail to the drawings, in FIG. 1 there is shown a holder 10 constructed in accordance with the teachings of the present invention having a spine 12 as a portion thereof. The spine 12 can be of a variety of shapes; triangular, semispherical or square, but is preferably rectangularly shaped. The spine 12 has integrally formed prongs 14, 16 and 18 which extend in parallel, spaced-apart relation to each other from a side of the spine 12. The holder 10 may be formed of metal or of a plastic or polyethylene material which will allow slight flexure along the length of the prongs to take place. The ends of prongs 14, 16 and 18 remote from spine 12 are free of each other so that the side portions of a container 20 can be received in slots 22 defined between prongs 14, 16 and 18, as explained below.

As shown particularly in FIG. 2, the edge surfaces 28 of prongs 14, 16 and 18 which define the sides of slots 22 are angled so that such slots 22 can conveniently receive closure flaps 24 and the adjacent side walls 26 of the container 20. Usually, the side surface 28 of one slot 22 are at an angle of about 135° in respect to the plane of prongs 14, 16 and 18 while the side surfaces 28 of the other slot 22 are oppositely angled, also at an angle of about 135°. Thus, the slots 22 extend at an angle of about 90° to each other. Upon placement of the holder 10 in its operative position shown in FIG. 3, the prongs will rest in substantially flush relationship to the side walls 26 and flaps 24 of the container 20. In order to ensure that the holder 10 will be properly oriented, one of the surfaces thereof may have a conspicuous color, mark or indicia applied thereto to indicate that such surface should be at the outside or inside when installed. In a preferred embodiment of the present invention, the holder has a length of 4.5 inches as measured in the direction along prongs 14, 15 and 16. It is, of course, to be realized that the slot-shaped openings 22 can be of a wide range of sizes to accept containers having sides and flaps of various sizes and shapes.

As further shown in FIG. 3, when installing the container holder 10, the latter is held directly over the corner 30 of the container 20, and the closure flaps 24 extending hingedly from the upper edges of the respective side walls 26 are folded downwardly to their open postions against the outer surfaces of walls 26. The outer prongs 14 and 18 may be slightly flexed in a direction transverse to the length thereof and away from the center prong 16. This movement can cause the central prong 16 to be situated internally of the carton or container and can also simultaneously situate the outer prongs along the outer surface of the closure flaps 24 which have been folded into their open position on the respective side walls 26 of the container. Such a placement then allows the container holder 10 to be easily slid over the corner 30 of the container 20 while simultaneously enabling the slots 22 to slidably receive both the side walls 26 and the closure flaps 24. Hence, in one simple sliding operation, the holder of the present invention safely secures two closure flaps 24 of container 20 in their open positions, thereby ensuring ease of access therein. It should also be realized that, depending upon the size of the slots 22, little or no flexure of the prongs 14, 16 and 18 is required.

Figure 4:
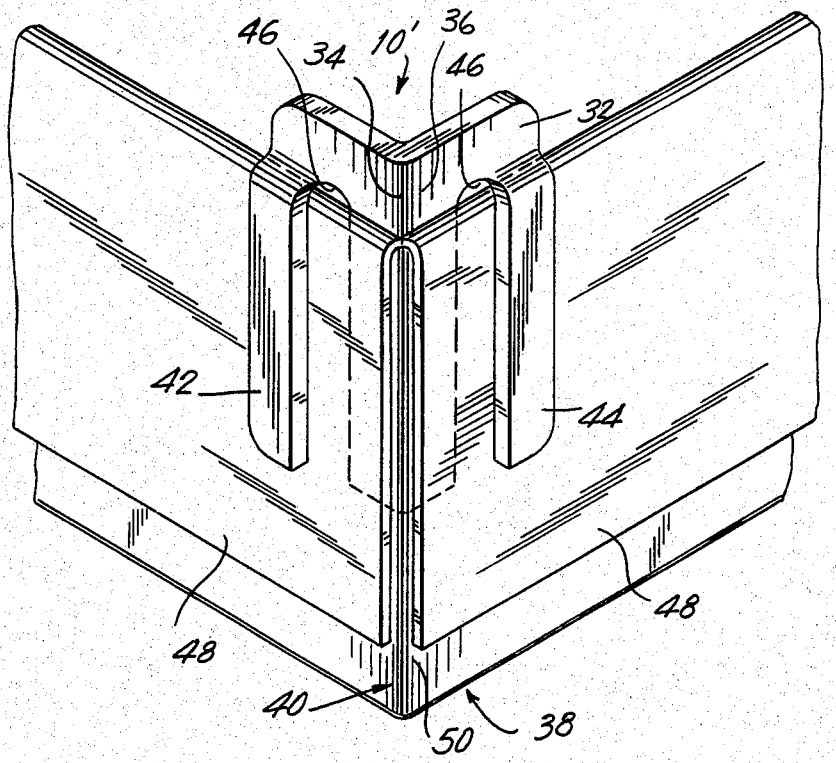
FIG. 4 is a perspective view of another embodiment of the present invention shown in position on a container.

In a holder 10' according to a second embodiment of the present invention, as shown in FIG. 4, the spine 32 is angled along the centerline 34 thereof, and the center prong 36 has a right-angled cross-section symetrical about such centerline 34. Upon sliding engagement of the holder 10' with the container 38, at a corner 40 of the latter, the right-angled center prong 36 comes into substantially flush engagement with the inner wall surfaces at corner 40 of the container 38. Further, the right-angled portions of center-prong 36 are preferably offset inwardly relative to the planes of the outer prongs 42 and 47. In this manner, the slots 46 defined between the center prongs 36 and outer prongs 42 and 44 can easily accept the closure flaps 48 and side walls 50 of the container.

By way of summary, it will be appreciated that holders 10 or 10' according to the present invention, as explained above, can be easily and effectively slid into engagement with the container 20 or 38 to maintain the closure flaps in an open configuration. It should be noted that the present invention normally requires only the use of two such holders 10 or 10' to hold open four closure flaps which are typically provided on each container.

Although preferred embodiments of the invention have been described and illustrated in detail herein, it should be realized that the invention is not limited to those particular embodiments, and that modifications and variations may be effected therein by one skilled in the art without departing from the spirit and scope of this invention as defined in the appended claims.

What is claimed is:

1. In combination, a container with closure flaps hingedly connected to the upper edges of respective sides of said container and adapted to be folded downwardly against said sides to open said container, and a holder for retaining said closure flaps of said container in said open condition, said holder comprising a spine portion, and a center prong and two outer prongs extending from a side of said spine portion, said prongs extending in a plane substantially parallel to each other from said spine portion and being spaced from each other to define slots between said prongs, said center prong and one of said outer prongs having parallel side surfaces which are angled approximately 45 degrees in relation to said plane of said prongs, said center prong and the other of said outer prongs having parallel side surfaces which are angled approximately 135 degrees in relation to said plane of said prongs, whereby upon sliding engagement of said holder with said container said closure flaps and container sides are received within said slots.

2. A holder as in claim 1, wherein said spine has a substantially rectangular shape.

3. A holder as in claim 1, wherein said holder is formed of plastic.

4. A holder as in claim 1, wherein said holder is formed of polyethylene.

5. A holder as in claim 1; wherein said holder of formed of metal.

* * * * *